United States Patent [19]

Hoever et al.

[11] 4,054,098

[45] Oct. 18, 1977

[54] EMBROIDERING MACHINE

[75] Inventors: Franz Hoever; Wolfgang Teetz, both of Kerken; Jürgen Bretschneider, Krefeld, all of Germany

[73] Assignee: Maschinenfabrik Carl Zangs Aktiengesellschaft, Krefeld, Germany

[21] Appl. No.: 724,105

[22] Filed: Sept. 16, 1976

[30] Foreign Application Priority Data

Sept. 17, 1975 Germany ..... 2541359

[51] Int. Cl.[2] ..... D05C 5/00; D05B 55/16

[52] U.S. Cl. ..... 112/86; 112/79 A; 112/221

[58] Field of Search ..... 112/84, 85, 86, 83, 112/221, 79 R, 79 A, 220

[56] References Cited

U.S. PATENT DOCUMENTS

| | | | |
|---|---|---|---|
| 3,172,380 | 3/1965 | Boyles | 112/221 X |
| 3,695,199 | 10/1972 | Rolauffs | 112/221 |
| 3,884,165 | 5/1975 | Tajima | 112/83 |
| 3,934,524 | 1/1976 | Smith | 112/79 A |

*Primary Examiner*—H. Hampton Hunter
*Attorney, Agent, or Firm*—Joseph A. Geiger

[57] ABSTRACT

Embroidering machine with a needle drive mechanism for color changeover, where each of a number of embroidering stations has a number of needles, one needle rod being working, i.e., engageable by a drive bar, all others being non-working and retained by a retaining bar, which also deflects the latch levers of these needle rods and which has a gap in the working plane for the working needle rod. In that gap is also arranged a solenoid controlled pivotable control pawl which, in its normal position, does not touch the working needle rod, and which, in its actuated position, bridges the gap of the retaining bar, thereby retaining the working needle and disengaging its latch lever from the drive bar. The needle bar, which carries all the needle rods, can then shift the needle rods into and out of the retaining bar gap.

14 Claims, 7 Drawing Figures

EMBROIDERING MACHINE

BACKGROUND OF THE INVENTION

1. Field of the Invention

The present invention relates to embroidering machines, and more particularly to pattern controlled fabric shifting embroidering machines, having a group of selectively operable needles for color or yarn selection in each of a number of embroidering stations.

2. Description of the Prior Art

Embroidering machines having a group of selectively operable needles in each of a number of embroidering stations, for the selective working of yarns of different color, or yarns of different materials, are known from the prior art. Such an embroidering machine normally has a number of embroidering stations which are regularly spaced across the width of the embroidering machine and in which identical embroidery designs are produced on a fabric which advances under the row of embroidering stations while executing pattern movements.

A needle bar, extending over the length of the machine, carries identical groups of needles in alignment with the embroidering stations, only one needle of each group being operated by the needle bar, while the other needles of the group are immobilized, each holding a different thread, ready to be switched into operation. A complex mechanism is required for the purpose of simultaneously executing identical needle switchover maneuvers in all needle groups.

In a known embroidering machine of this type, disclosed in U.S. Pat. No. 3,884,165, each needle group consists of a certain number of needle rods which carry the embroidering needles and which hold each a different thread. A selector mechanism, designed to operate only one of the needles out of each needle group, features a drive shaft extending across the machine and carrying a drive lever for each needle group. The reciprocating motion of the drive lever is transmitted to the selected needle rod in a two-way positive engagement between the drive arm and the needle rod. In order to switch from one needle rod in the group to another, the drive shaft has to come to a stop in a position in which the needle rods are aligned. This requirement reflects itself in a complex selector mechanism and it is detrimental to the productivity of the machine, due to the need to stop the drive shaft movement.

In another prior art machine of this type, disclosed in U.S. Pat. No. 3,338,194, the switchover is accomplished pneumatically, the needle rods taking the form of small pneumatic cylinders, relative to which the needles are longitudinally adjustable, taking the place of piston rods which protrude from the cylinder-type needle rods. The latter are fixedly attached to the needle bar which executes the stitching motion. An appropriate selector valve energizes the selected needle rod, thereby extending the needle, while all other needles remain retracted, being held by a spring. Though all needles execute the reciprocating motion of the needle bar, only the extended needles reach far enough to produce embroidery stitches.

This prior art solution is complex, inasmuch as it requires a great number of small pneumatic cylinders, with an equal number of separate air supply lines. Furthermore, the needles are poorly guided in their extended position. These needles have a tendency to bind in the extended position, if they are accidentally distorted from the true straight shape.

SUMMARY OF THE INVENTION

It is a primary objective of the present invention to suggest an improved embroidering machine of the type described hereinabove, having identical groups of needle rods with thread holding needles arranged in a number of embroidering stations, the machine having a drive control mechanism which makes it possible to temporarily disconnect and retain the needle rod which is positioned in the working plane, in order to execute a simultaneous needle switchover in all the needle groups, without requiring that the needle drive be stopped for this purpose, and in order to either temporarily suppress the stitching action of all the working needles, for the production of a skip stitch between spaced embroidery designs, or to permanently suppress the stitching action of selected needle groups.

The present invention proposes to attain these objectives by suggesting, in conjunction with an embroidering machine of the type having a needle group in each of a number of embroidering stations, a needle drive control mechanism which includes a guided needle rod for each needle and a drive head attached to each needle rod, so that the one needle which is located in the working plane will be engaged by a reciprocating drive bar, through the action of a latch lever, while all the other needle rods are being retained in their retracted positions.

Accordingly, one needle rod out of each group of needle rods serves as the working needle rod, while all the other needle rods are non-working. By shifting a previously non-working needle rod into the working plane, it becomes the working needle rod, as the previously working needle rod becomes non-working. This switchover, which takes place simultaneously in all needle groups, is preferably performed by a transversely shiftable needle bar which carries all the needle rods of the machine.

In a preferred embodiment of the invention, the latch levers are pivotably attached to the drive heads of the needle rods and spring-loaded in the direction of engagement with the reciprocating drive bar. In order to immobilize the non-working needle rods, they are retained in their retracted positions by a stationary retaining bar which extends across all needle positions, but has a gap in alignment with the working plane. The retaining bar engages appropriate abutment collars on the rear extremities of the non-working needle rods, while deflecting their latch levers out of reach of the reciprocating drive bar. Only the working needle rod, located in the gap of the retaining bar, is not immobilized by the latter. Its latch lever is thus free to pivot into engagement with the reciprocating drive bar, for a stitching action of its needle.

The present invention now suggests that the engagement between the working needle rod and the reciprocating drive bar be selectively suppressible by means of an appropriate control assembly arranged in the gap of the retaining bar, in alignment with the working plane of the embroidering station.

In a preferred embodiment of the invention, this control assembly features a pivotable control pawl which occupies the gap of the retaining bar and which is pivotable between a normal position in which it does not interfere with the working needle rod and its latch lever and a stitch suppressing position in which the control pawl retains the working needle rod in its retracted position and simultaneously deflects its latch lever out of engagement with the reciprocating drive bar. The shape of the control pawl is preferably such that, when it is positioned for stitch suppression, it fills the retaining bar gap in such a way that it forms a continuation of the retaining bar, so that the working needle rod and its latch lever are in alignment with the non-working needle rods and their latch levers, respectively. In this aligned configuration, the needle rods can be shifted transversely, for a switchover from one needle rod to another as working needle rod.

This novel capability of selectively suppressing the stitching action of the working needle rod makes it possible to perform a switchover maneuver of the needle bar, for a change of color, for example, while the drive bar continues its reciprocating movement. The result is a smoother, more productive operation of the machine.

The capability of the device of the invention to selectively suppress the stitching action of the working needle rod gives the embroidering machine two important additional advantages: It makes it possible to temporarily stop the embroidering action of the entire machine, without interrupting its drive, by simultaneously blocking all the working needle rods, when one embroidery design is completed and the machine advances to the next embroidery design over fabric which is not to receive any stitches. Prior art machines do not have this capability, producing stitches in the interspace between embroidery designs which have to be removed thereafter by hand. Alternatively, the novel drive control mechanism makes it possible to permanently shut down a given needle group, by permanently retaining its working needle rod in the retracted position. This capability can be taken advantage of, when fewer than all the needle groups are used in the embroidery setup, or when embroidery designs are produced whose width exceeds the spacing between two needle groups.

In the preferred embodiment of the invention, each needle rod, besides being guided in a guide bore of the needle bar, is also guided by a rearwardly extending fixed guide rod engaging a bore of its drive head. To the rear extremity of each needle rod is attached an abutment collar, the latter being preferably adjustably held between clamping nuts which are seated on a threaded portion of the needle rod. The cooperating retaining bar is preferably a simple angle profile, the abutment collars engaging an edge portion of the retaining bar from behind, while another edge of the retaining bar deflects the latch levers.

The latch levers of the needle rods are pivotably attached to their drive heads, each latch lever having the shape of a double arm lever, with a trip arm reaching rearwardly so as to cooperate with the retaining bar, and a hook-shaped latch arm reaching forwardly so as to be pivotable into and out of engagement with the reciprocating drive bar. A suitable latch spring urges the latch lever into a position in which it will be engaged by the drive bar, while the retaining profile holds the latch levers of the non-working needle rods in a non-engageable position. The same function is also performed by the control pawl, when the needle rod in the working plane is to remain temporarily retracted and out of operation.

The control means for stitch suppression through temporary immobilization of the working needle rod is preferably a control assembly which is operated by a solenoid, a control arm linking the solenoid armature to the control pawl, thereby pivoting the latter between a normal, stitch actuating position and a stitch suppressing position. In stead of a solenoid drive for the control assembly, it is also possible to use a pneumatic drive, or some other suitable mechanical or electromechanical drive means.

The control assembly is preferably so arranged that it allows for a timing overlap between the reciprocating motion of the drive bar and the control motion of the solenoid, using a stop link which blocks the movement of the solenoid armature, until the drive bar has returned the needle rod to its fully retracted position. This is accomplished by a lifter on the drive bar which disengages a spring-loaded stop link from a notch in the control arm of the control assembly.

Alternatively, it is also possible to obtain a timing overlap by arranging the needle rod retaining elements in such a way that at least one of them is resiliently yielding, so that the returning needle rod executes a snap action at the point of reaching its fully retracted position, in which it is then retained. This snap action retaining feature may be provided on the fixed retaining bar as well as on the pivotable control pawl of the control assembly.

As an alternative to the one-piece needle bar which extends from one end of the machine to the other, it is also possible to provide separate needle bars for each needle group in the machine. Instead of straight-line guides for the needle bars, it is also possible to arrange these needle bars in such a way that they are guided along curved paths. The movement of the needle bar, or needle bars, for the switchover from one color to another, or from one kind of thread to another, is normally controlled by the same pattern control mechanism, a punched tape mechanism, for example, which also controls the advance and lateral displacements of the embroidering frame platen carrying the fabric. The temporary immobiliztion of the working needle rods during the switchover movement of the needle bar can likewise be controlled automatically through a special track on the punched tape.

BRIEF DESCRIPTION OF THE DRAWINGS

Further special features and advantages of the invention will become apparent from the description following below, when taken together with the accompanying drawings which illustrate, by way of example, a preferred embodiment of the invention, represented in the various figures as follows.

DESCRIPTION OF THE PREFERRED EMBODIMENT

Figure 1:
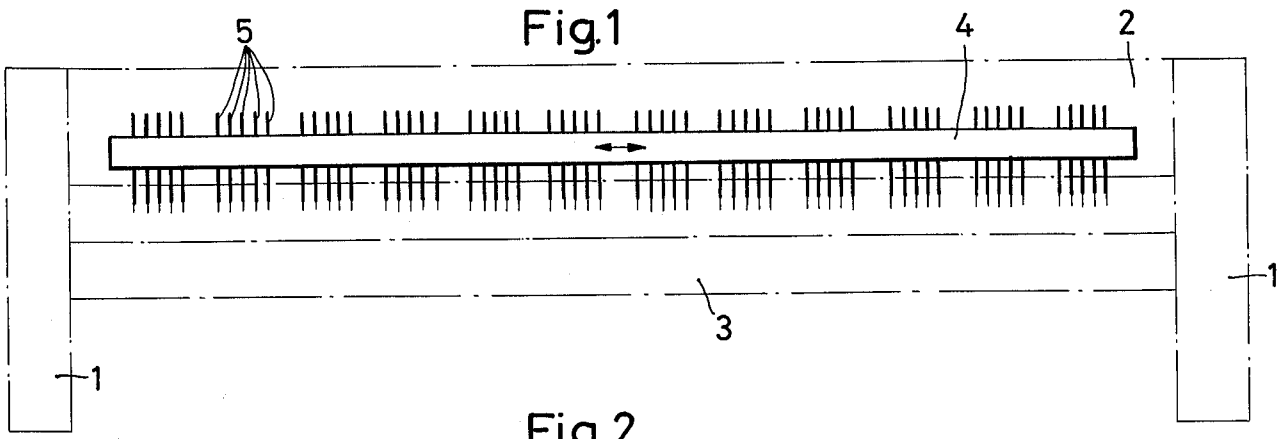
FIG. 1 shows the elevational outlines of an embroidering machine with a needle bar holding a number of needle groups.
Figure 2:
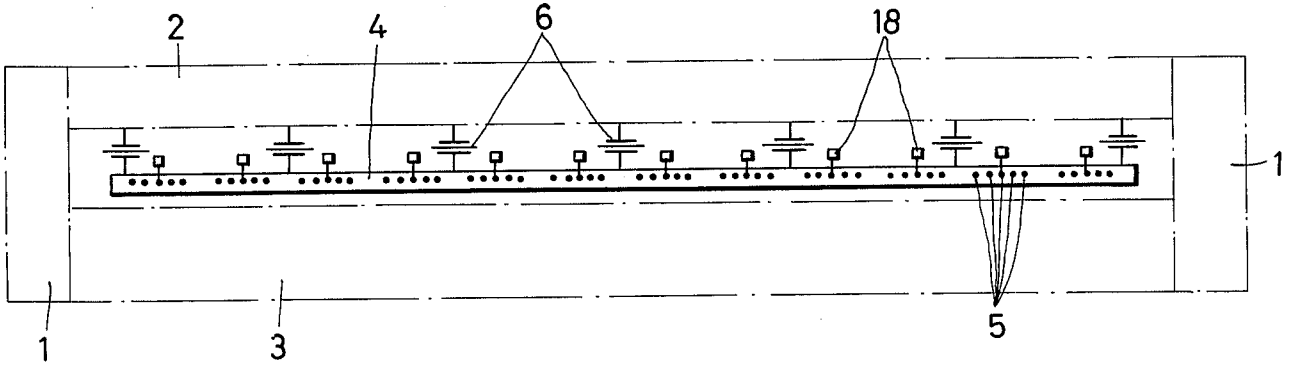
FIG. 2 is a similarly schematic plan view of the machine of FIG. 1.

Referring to FIGS. 1 and 2 of the drawing, there is shown, in outline only, an embroidering machine of the type preferably employed in conjunction with an embodiment of the present invention. This machine consists essentially of two spaced end standards 1 which are rigidly connected across the machine by a rear portal beam 2 and a front tie beam 3. The latter carries the table or platen of the machine, omitted from the drawing for the sake of clarity.

The portal beam 2 carries a needle bar 4 which, in the embodiment illustrated, is a single member extending across the entire width of the machine. The needle bar 4 is guided for lateral displacements, carrying 12 groups of needle rods 5 in alignment with 12 embroidering stations on the embroidering platen (not shown). In the example shown, each embroidering station has five identical needle rods 5 arranged in a row on the needle bar 4.

In FIG. 2 are schematically indicated several straight-line guides 6 guiding the needle bar 4 in its needle shifting displacements in relation to the portal beam 2. The drive mechanism which produces the needle shifting displacements of the needle bar 4 may be of a known stepping type. Its details being deemed unnecessary for an understanding of the operation of the novel needle drive control mechanism of this invention, the needle bar drive has likewise been omitted from the drawings, for the sake of greater clarity. Suffice it to say that the needle bar is laterally displaceable in such a way that any one of the five needle rods 5 in each embroidering station can be brought into alignment with a fixed working plane of the embroidering station.

Accordingly, the embroidering machine of FIGS. 1 and 2 has twelve embroidering stations, defining twelve fixed working planes, identically numbered needle rods 5 in all 12 needle rod groups being simultaneously aligned with the 12 working planes. The following detailed description of the needle drive control mechanism of the invention will therefore concern itself with only one needle group, and it should be understood that it equally applies to all other needle groups of the embroidering machine.

The several needle rods 5 of each needle rod group carry each a needle with a different embroidery thread, for the production of embroidery in different colors and/or different yarn material. Accordingly, the machine of FIGS. 1 and 2 is capable of simultaneously producing 12 identical embroidery designs, using as many as five different kinds of embroidery thread. Of course, it is also possible to use different needles in the five needle rods of an embroidering station, as when some of the needles are used for boring or punching operations. The lateral position of the needle bar 4 determines which one of the five needle rods in the working needle rod which is being used in the embroidering process; the other four needle rods 5, located outside the working plane of the embroidering station, are non-working needle rods and must accordingly remain retracted and out of reach of the needle drive mechanism of the machine. How this is being accomplished will now be described in reference to FIGS. 3–7 of the drawing.

Figure 3:
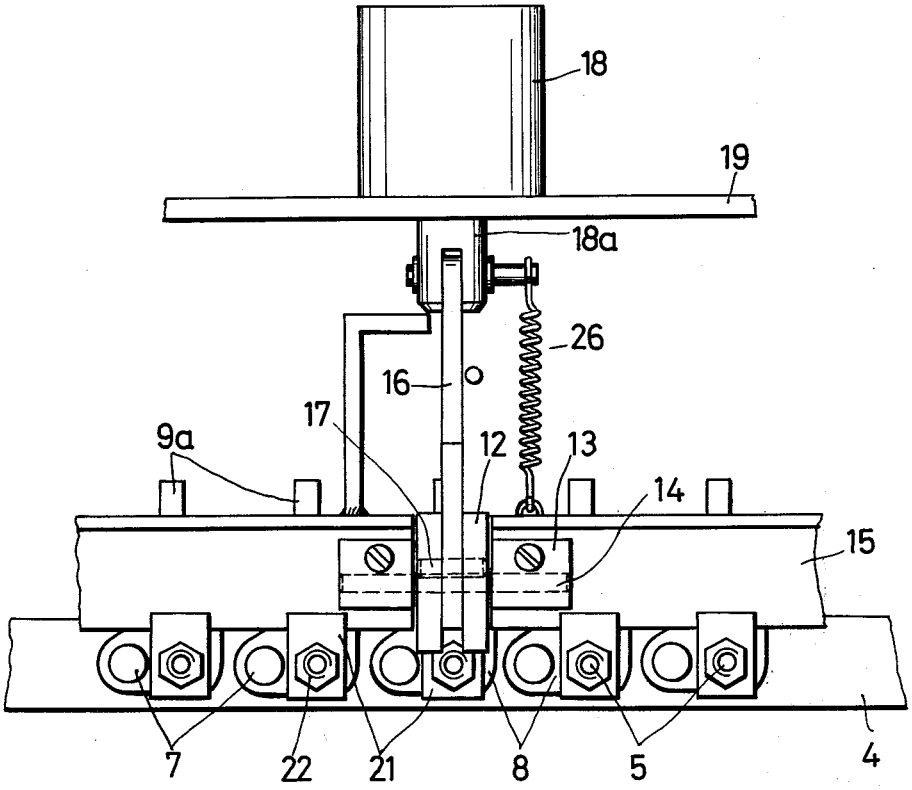
FIG. 3 shows, in enlarged detail, a plan view of a single needle group of the machine of FIG. 2, with a drive control mechanism embodying the present invention.
Figure 5:
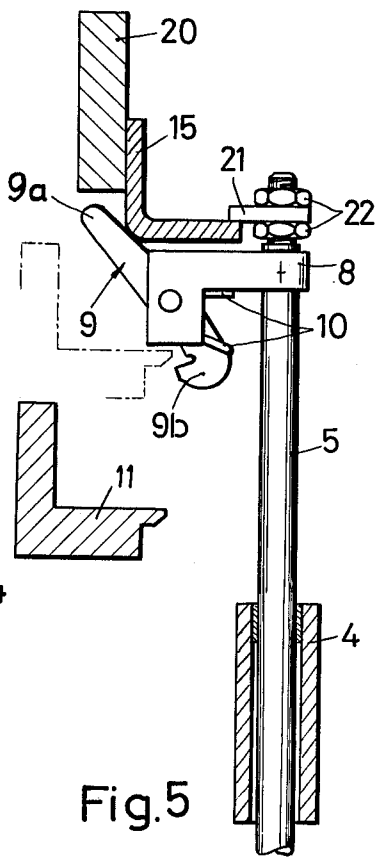
FIG. 5 is a cross section along line V—V of FIG. 4.
Figure 4:
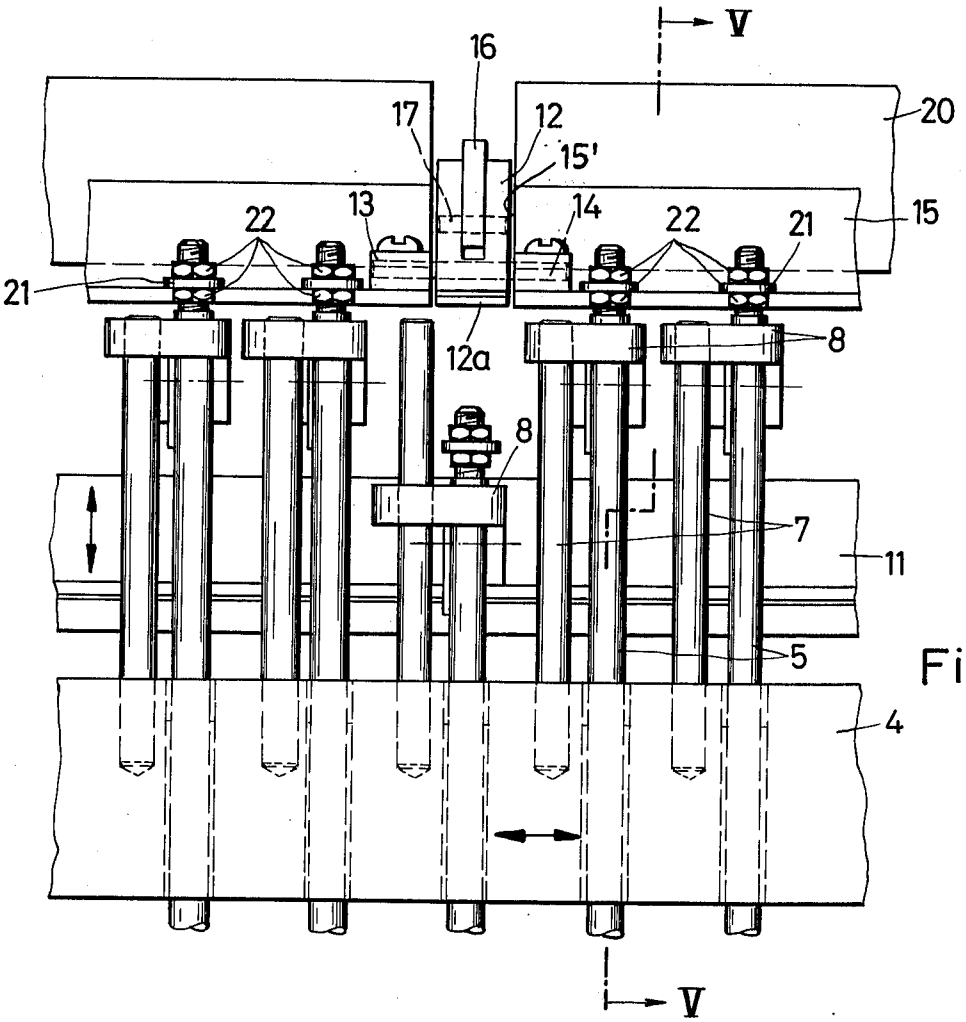
FIG. 4 shows the needle group of FIG. 3 in an elevational view.

In FIG. 4 is shown, at a greatly enlarged scale, one of the twelve needle groups of the machine of FIG. 1, a corresponding plan view and side view being given in FIG. 3 and FIG. 5, respectively. The needle group of FIG. 4 consists essentially of five parallel, regularly spaced needle rods 5, extending through guide bores in the needle bar 4, each needle rod 5 being additionally guided by a fixed guide rod 7 which extends rearwardly from the needle bar 4. Engaging each guide rod 7 is a drive head 8 which is fixedly attached to the rear portion of a needle rod 5 and which carries a latch lever 9 in a pivot connection (FIG. 5), to be described in detail further below.

Extending across the width of the embroidering machine is a frame member 20 which holds a retaining bar 15 (FIGS. 4 and 5). The retaining bar 15 has a central gap 15', located in alignment with the working plane of the embroidering station. The function of the retaining bar 15 is to retain the four non-working needle rods 5 in their retracted position and to prevent their latch levers 9 from being engaged by a reciprocating drive bar 11.

This configuration is shown in FIG. 5, where it can be seen that the angle-shaped retaining bar 15, while reaching under an abutment collar 21 of each needle rod 5 with one edge portion, deflects its latch lever 9 out of reach of the reciprocating drive bar 11 with another edge portion.

Figure 6:
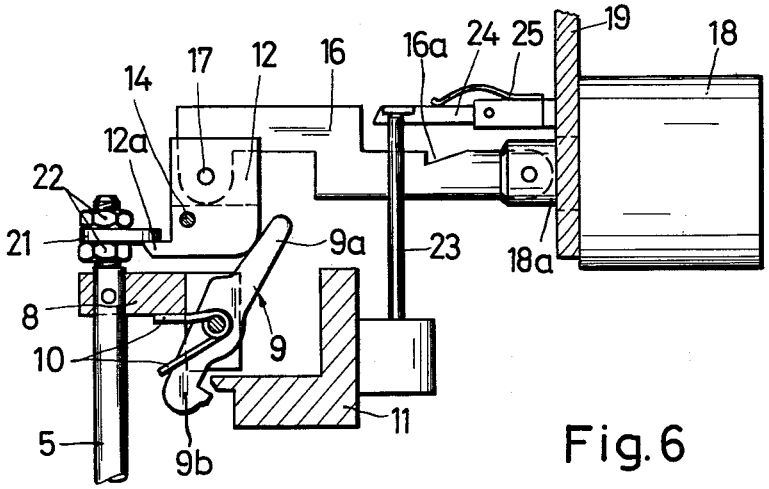
FIG. 6 is a cross section comparable to that of FIG. 5, showing a control assembly in its stitch suppressing position.

The latch lever 9, which can best be seen in FIG. 6, is a double-arm lever, having a trip arm 9*a* extending rearwardly from the drive head 8 and a hook-shaped latch arm 9*b* extending forwardly therefrom. A latch spring 10 of the torsion spring type engages the latch arm 9*b* of lever 9, urging it away from the needle rod 5, into the path of a reciprocating drive bar 11 (see FIGS. 6 and 7). The drive bar 11 extends all the way across the width of the embroidering machine, driving the working needle rod of each needle rod group.

Figure 7:
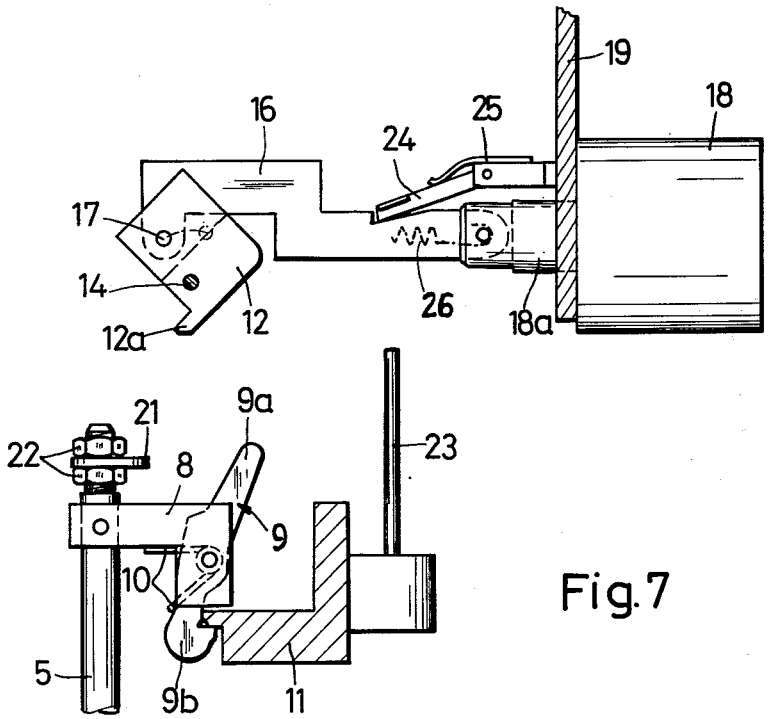
FIG. 7 shows the control assembly of FIG. 6 in its stitch actuating position.

In FIGS. 6 and 7 is shown a control assembly which is mounted in alignment with the working plane and which cooperates with the working needle rod 5 in the following manner: A control pawl 12 is pivotably supported in the gap of the retaining bar 15 (FIG. 4), being supported on a pivot pin 14 extending between pivot blocks 13 which are attached to the retaining bar on either side of its gap. The control pawl 12 is pivotable between two control positions shown in FIG. 6 and FIG. 7, respectively.

The normal or operating position of the control assembly is that shown in FIG. 7, where the control pawl 12 is so oriented that it will not touch any part of the needle rod 5, as the latter executes a stitching motion. The needle rod 5 receives this motion from the reciprocating drive bar 11, by engaging a drive nose of the latter with the latch arm 9*b* of its latch lever 9, under the influence of the latch spring 10.

In a second position of the control assembly, as shown in FIG. 6, the control pawl 12 deflects the latch lever 9, so as to disengage it from the drive bar 11, while at the same time retaining the needle rod 5 in its retracted position. In doing so, the control pawl 12 and the working needle rod 5 assume the same configuration as does the retaining bar 15 with the non-working needle rods (FIG. 5). The control pawl 12 thus effectively bridges the gap 15' of the retaining bar 15 (see FIG. 4), making it possible for the needle bar 4 to shift the group of needle rods into any desired position, including into, out of, and past the gap 15' in the retaining bar.

The needle rods 5 are retained in their fully retracted position by a simple abutment collar 21, clamped between two clamping nuts 22 which are seated on the threaded rear end portion of the needle rod 5. The control pawl 12 has a retaining nose 12*a* which is so oriented with respect to its pivot pin 14 that it engages the abutment collar 21 from the front, when the control pawl 12 is pivoted from its normal position of FIG. 7 into its stitch suppressing position of FIG. 6. The abutment collars 21 of the needle rods 5 are preferably so adjusted that this pivoting action of the control pawl 12 causes the needle rod 5 to be retracted a small distance beyond the position to which it is moved by the drive bar 11, in order to create a clearance between the latter and the drive head 8 of the retained needle rod 5.

The pivoting movements of the control pawl 12 are derived from a solenoid 18 which is mounted on a stationary supporting bracket 19, and whose armature 18*a* is linked to the control pawl 12 by means of a control arm 16 and a connecting pin 17. The normal position of the control assembly is maintained by a tension spring 26 which extends between the solenoid armature 18*a* and the retaining bar 15 (see FIG. 3). It is thus possible to selectively suppress the stitching action of the working needle rod 5, by energizing the solenoid 18, which then immobilizes the needle rod 5, until the solenoid is deenergized.

In order to improve the timing of the control assembly in relation to the rapid reciprocating motion of the drive bar 11, the invention further suggests a trigger mechanism on the control assembly which is mechanically actuated by the movement of the drive bar 11. For this purpose, the control assembly includes a pivotable stop link 24 which is biased into a notch 16*a* of the control arm 16 by means of a leaf spring 25. As shown in FIG. 7, the stop link 24 and the notch 16*a* of the control arm 16 are aligned, when the control assembly is in its normal position. The engaged stop link 24 is so positioned that a lifter 23, carried by the drive bar 11, engages a nose on the stop link 24 in the final portion of the drive bar movement, thereby lifting the stop link 24 from its notch 16*a* at the end of each drive bar stroke. In normal operation, the stop link 24 returns into the notch 16*a,* as soon as the drive bar moves forwardly in its next stroke. Thus, if the solenoid 18 is energized at a point in time at which the drive bar 11 is not in, or immediately close to, its retracted position, the stop link 24 will block the control arm movement, until the lifter 23 disengages the stop link 24 from the notch 16*a.*

This mechanism configuration positively assures an accurate timing between the movements of the working needle rod 5 and the control pawl 12, when the control assembly is operated to suppress the stitching action of the working needle rod 5. The timing of the release action of the control assembly is not crucial, the latch arm 9*b* of the latch lever 9 being so shaped that the drive bar 11 will snap into driving engagement with the latch lever 9, if that lever should have assumed its engagement position prior to the time at which the drive bar 11 reaches its fully retracted position.

As an alternative to the configuration of FIGS. 6 and 7, it is also possible to modify the abutment member 21 of the working needle rod 5 and the cooperating retaining nose 12*a* of the control pawl 12 in such a way that the control pawl, if pivoted into its stitch suppressing position (FIG. 6), prior to the arrival of needle rod, produces a snap action with the abutment collar 21, as the needle rod 5 moves towards its fully retracted position. Such a modification would make it possible to dispense with the previously described triggered timing function obtained with the stop link 24 and the lifter 23.

The drive control mechanism of the present invention thus makes it possible to operate multi-color embroidering machines at a very high speed, as color changes can be exected without stopping the drive mechanism. It also makes it possible to stop the needles during the advance from one embroidery design to the next, and to completely shut down selected embroidering stations.

It should be understood, of course, that the foregoing disclosure describes only a preferred embodiment of the invention and that it is intended to cover all changes and modifications of this example of the invention which fall within the scope of the appended claims.

We claim the following:

1. In an embroidering machine of the type in which the fabric, while advancing through the machine, is also shifted laterally in accordance with an embroidery control pattern, and in which several identical embroidery designs are produced simultaneously in a number of embroidering stations which are spaced across the machine, as one out of a group of needles arranged in each embroidering station is being driven to execute a stitching motion while the other needles in the group remain retracted, holding threads of varying color or texture, for the selective embroidering with different threads, through switchover of the needle driving means of the machine from one needle to another in each needle group; in such a machine, a needle drive control mechanism comprising in combination:

in each embroidering station, a group of needle rods arranged in a row, each needle rod carrying a needle which protrudes from its forward end;

a needle bar which holds and guides the row of needle rods for longitudinal displacement between an advanced position in which stitch formation takes place and a retracted position, including means for shifting the needle bar in a direction transverse to the needle rod axes, so as to align any selected needle rod of the group with a fixed working plane of the embroidering station;

a stationary retaining bar arranged rearwardly of and parallel to the needle bar and having a gap in alignment with said working plane, the retaining bar cooperating with all the needle rods of the group, with the exception of the one which is aligned with said working plane and retaining bar gap, and which thus serves as a working needle rod, the needle bar retaining, by said cooperation, the other, non-working needle rods in their retracted position, while allowing for a transverse displacement of the retained needle rods along the retaining bar, when the needle bar executes its transverse shifting movement;

needle rod retaining means defined between the stationary retaining bar and the needle rods, for retaining said non-working needle rods in the manner aforementioned, said retaining means including a retaining protrusion on each needle rod.

selectively releasable means for holding the working needle rod in its retracted position, in substantial alignment with the non-working needle rods, so as to allow for a shift of the working needle rod into the range of the retaining bar, thereby rendering it non-working, and to also allow for a simultaneous shift of a previously non-working needle rod into the working plane, when the needle bar executes said transverse shifting movement;

a needle rod drive member arranged in cooperational proximity of at least the working needle rod in the working plane of each group, said drive member executing a reciprocating motion which, if transmitted to a working needle rod, moves the latter between its advanced and retracted positions in a stitching action; and means for releasably connecting the working needle rod with said drive member, each needle rod including, as part of said connecting means, a movable connecting member which is engageable by the drive member; and wherein:

said working needle rod holding means and said working needle rod connecting means are operatively interconnected in such a way that the holding means, when holding the needle rod in its retracted position, deflects the connecting member of the working needle rod into a position in which it cannot be engaged by the reciprocating drive member.

2. A needle drive control mechanism as defined in claim 1, wherein the working needle rod holding means includes a movable control member and a selectively operable drive means connected thereto which is adapted to move the control member between a normal release position in which the working needle rod is free to move longitudinally in a stitching stroke, and a holding position in which the control member engages said protrusion of the working needle rod, when the latter is in its retracted position, thereby suppressing any stitching stroke; and the shape of the movable control member is such that, in its stitch suppressing position, said member bridges the gap of the stationary retaining bar, to allow for a transverse displacement of the retained needle rods from the retaining bar onto the control member, and vice versa.

3. A needle drive control mechanism as defined in claim 2, wherein the stationary retaining bar has a cross-sectional shape which causes the connecting members of the non-working needle rods to be deflected into a position in which they cannot be engaged by the reciprocating drive member; and the movable control member, in its stitch-suppressing position, similarly deflects the connecting member of the working needle rod, bridging the retaining bar gap so as to maintain the connecting members of the retained needle rods deflected, when they are displaced transversely as aforesaid.

4. A needle drive control mechanism as defined in claim 2, wherein the movable connecting member of a needle rod is a latch lever which is pivotably attached to the needle rod and biased towards the path of the reciprocating drive member, for driving engagement against the latter, when the control member is moved from its holding position to its release position.

5. A needle drive control mechanism as defined in claim 4, wherein each needle rod has a drive head fixedly attached thereto near its rear extremity;

said pivot attachment between the latch lever and the needle rod is arranged in the drive head; and the latch lever is a double-arm lever, having a trip arm extending generally rearwardly from its pivot connection and a latch arm extending generally forwardly therefrom.

6. A needle drive control mechanism as defined in claim 5, wherein each needle rod further includes, as part of said working needle rod connecting means, a latch spring disposed between its latch lever and its drive head, said spring biasing the latch lever as aforesaid.

7. A needle drive control mechanism as defined in claim 5, wherein the retaining protrusion of the needle rod is located a distance behind the pivot connection of the latch lever;

the rearwardly extending trip arm of the latch lever extends at least as far as said protrusion and at a lateral distance therefrom in the working plane; and the control member of the needle rod holding means is a pivotable control pawl, having its pivot axis located between said protrusion and trip arm of the working needle rod and oriented perpendicularly to the working plane.

8. A needle drive control mechanism as defined in claim 2, wherein the selectively operable drive means of the working needle rod holding means includes a unidirectionally effective motor means and an opposing resetting spring which are connected to the movable control member of said holding means, the resetting spring biasing the control member towards its release position, and the motor means moving it towards its holding position.

9. A needle drive control mechanism as defined in claim 8, wherein said motor means is an electromagnet.

10. A needle drive control mechanism as defined in claim 8, wherein said motor means is of the type which, when energized while being blocked against movement, exerts a force in the direction of motive power and maintains said force, until it is either deenergized or released in movement;

the working needle rod holding means further includes control member trigger means blocking the motor means against moving the control member to its holding position, except when the reciprocating drive bar is near the rearward end position of its stroke; and said trigger means is in part defined by the reciprocating drive bar and so arranged that its blocking action is eliminated by the drive bar, as it moves to the rearward end position of its stroke.

11. A needle drive control mechanism as defined in claim 2, wherein the motor means is connected to the control member by means of a control arm;

the control member trigger means includes a stop link which is movably supported by a stationary part and biased against said control arm;

the control arm, when the control member is in its release position, presents a protrusion to the stop link, for control arm blocking engagement by the latter;

the drive bar includes a lifter, as part of said trigger means; and the lifter moves along a path, at the rear end point of which it deflects the stop link out of reach of said control arm protrusion.

12. A needle drive control mechanism as defined in claim 2, wherein the movable control member of the working needle rod holding means has such a shape and movement that, when it is moved from its normal position to its holding position, following return of the working needle to its fully retracted position, it cooperates with the retaining protrusion of the working needle rod to further move the latter rearwardly a small distance, away from the drive member; and the retaining bar is so positioned that the non-working needle rods retained by it are positioned in substantial alignment with said further retracted working needle rod.

13. A needle drive control mechanism as defined in claim 1, wherein the stationary retaining bar has a uniform cross-sectional profile which includes an edge portion presenting a rearwardly oriented retaining face; and the retaining protrusions of the needle rods are, in each case, an abutment collar extending substantially radially from the needle rod and presenting a forwardly oriented face which is engageable against the retaining face of the retaining bar.

14. A needle drive control mechanism as defined in claim 13, wherein the abutment collar of the needle rod is axially adjustable, being clamped in position on the rear portion of the needle rod by a threaded fastener.

* * * * *